US006914614B2

(12) United States Patent
Kobayashi

(10) Patent No.: US 6,914,614 B2
(45) Date of Patent: Jul. 5, 2005

(54) COLOR DISPLAY METHOD AND SEMICONDUCTOR INTEGRATED CIRCUIT USING THE SAME

(75) Inventor: Kazuo Kobayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 141 days.

(21) Appl. No.: 10/001,086

(22) Filed: Oct. 31, 2001

(65) Prior Publication Data

US 2002/0109702 A1 Aug. 15, 2002

(30) Foreign Application Priority Data

Oct. 31, 2000 (JP) ..... 2000-333934

(51) Int. Cl.[7] ..... G09G 5/02

(52) U.S. Cl. ..... 345/600; 345/597; 345/589; 345/605; 382/162; 382/167

(58) Field of Search ..... 345/589, 597, 345/600, 605, 612–613, 204, 205, 22, 72, 80, 77, 83, 88–90, 87; 710/316; 365/230.3; 382/162, 164, 165, 167; 358/515, 518, 519; 348/599, 612, 617, 624

(56) References Cited

U.S. PATENT DOCUMENTS 5,598,184 A * 1/1997 Barkans ..... 345/597
5,793,899 A * 8/1998 Wolff et al. ..... 382/260
5,941,974 A * 8/1999 Babin ..... 710/316
6,151,265 A * 11/2000 Takita et al. ..... 365/230.03
6,208,325 B1 * 3/2001 Reddy et al. ..... 345/658
6,573,901 B1 * 6/2003 Rai ..... 345/547

FOREIGN PATENT DOCUMENTS

| | | |
|---|---|---|
| JP | 2-226416 | 9/1990 |
| JP | 2-230190 | 9/1990 |
| JP | 8-83055 | 3/1996 |
| JP | 11-15444 | 1/1999 |
| JP | 2000-137466 | 5/2000 |
| JP | 2000-293144 | 10/2000 |

* cited by examiner

*Primary Examiner*—Matthew C. Bella
*Assistant Examiner*—Wesner Sajous
(74) *Attorney, Agent, or Firm*—Rosalio Haro

(57) ABSTRACT

The data bits of a first image data unit representing a first range of 0–255 continuous color tones are mapped to a second image data unit having an expanded bit count capable of representing a second range of continuous color tones greater the first range. Of the available colors tones in the second range, 256 color tones are selected and associated with the 256 data combinations achievable with the first image data unit. A decoder is used to convert each data combination in the first image data unit into its corresponding color tone from the second range, which defines its conversion into a second image data unit. In this manner, one can expand the range of displayable colors to approximate the display of true colors associated with a higher resolution without increasing the number of bits of the first image data unit, which is input to a driver IC by an MPU.

12 Claims, 5 Drawing Sheets

COLOR DISPLAY METHOD AND SEMICONDUCTOR INTEGRATED CIRCUIT USING THE SAME

BACKGROUND OF THE INVENTION

1. Field of the Invention

The present invention relates to a color display method for specifying a plurality of color tones on a display, such as on an LCD display. Furthermore, the present invention relates to a semiconductor integrated circuit (driver IC) that drives a display, such as an LCD for instance, using the color display method of the present invention.

2. Description of the Related Art

A conventional color LCD driver IC receives input image data units from a microprocessing unit, i.e. MPU, or other type of data processing unit. Conventional image data units consists of eight data bits per pixel specifying a red, green and blue (RGB) color tone combination for each pixel. The eight data bits of each pixel's image data unit are composed of three bits for specifying a red color (R) tone, three bits for specifying a green color (G) tone, and two bits for a for specifying a blue color (B) tone. The image data is successively written to a RAM built within the driver IC. Since $2^3$ is 8 and $2^2$ is 4, the eight data bits of a conventional image data unit can specify 8×8×4, or 256, colors tone combinations for display. This feature is shown in FIG. 5.

In FIG. 5, three bits, D7–D5, of one pixel's image data unit, bits D7–D0, that are input from the MPU can represent up to eight different color tones, or color gradients, for the color red. Similarly, the next three bits, D4–D2, can represent up to eight color tones for the color green, and the last two bits, D1–D0, can represent up to four color tones for the color blue.

Additionally, Japanese laid-open patent application 6-167959 describes a color display control apparatus that realizes a display for simultaneous coloring of 256 colors. The display control apparatus provides a latch circuit for four data input lines of a random access memory digital to analog converter, RAMDAC, that is not conventionally used to latch display data, and combines the same with display data that is input to four data input lines of a RAMDAC that is conventionally used.

In any case, the range of color tones that can be displayed is determined by the number of bits in each pixel's image data unit that are input to a driver IC (a color display control apparatus) from an MPU. Since the number of bits per image data unit that is commonly available to color LCD driver ICs is eight bits, the range of color tones that can be displayed are commonly limited to a continuous range of 0–255, or 256, colors tones.

However, in recent years, additional diversification of color tones in color displays has been sought, and there are cases where the available continuous range of 256 color tones cannot meet the demands of users.

OBJECTS OF THE INVENTION

Accordingly, in view of the above, it is an object of the present invention to expand the range of displayable color tones without increasing the number of bits per image data unit that is input to a driver IC from an MPU.

It is another object of the present invention to use available bits in an image data unit to approximate the display of true colors, which are typically associated with a higher resolution color range.

SUMMARY OF THE INVENTION

To solve the problems described above, a color display method in accordance with the present invention is equipped with the steps of: successively inputting first image data units consisting of N bits per pixel specifying a first RGB color tone, or gradient, for each pixel (wherein N is a natural number that is three or greater); converting each pixel's first image data unit, based on a set conversion algorithm, into a second image data unit defining a second RGB color tone and including a first color tone data sub-unit of K bits, a second color tone data sub-unit of L bits, and a third color tone data sub-unit of M bits (where K, L and M are natural numbers, and K+L+M>N); successively storing the first through third color tone data sub-units obtained for a plurality of pixels; and successively generating and outputting, for the plurality of pixels, first through third color control signals for producing each pixel's corresponding second RGB color tone as defined by each pixel's respectively stored first through third color tone data sub-units.

Here, the first image data unit may have eight bits, the first color tone data sub-unit may define a red color tone and consist of four to six bits, the second color tone data sub-unit may define a green color tone and consist of four to six bits, and the third color tone data sub-unit may define a blue color tone and consist of four to six bits.

Also, a semiconductor integrated circuit in accordance with the present invention is equipped with: a data conversion device in which first image data units defining respective first RGB color tones in N bits for each pixel (wherein N is a natural number that is three or greater) is input, and which coverts the first image data units, based on a set conversion algorithm, into second image data units defining respective second RGB color tones, with each including a respective first color tone data sub-unit in K bits, a respective second color tone data sub-unit in L bits, and a respective third color tone data sub-unit in M bits (where K, L and M are natural numbers, and K+L+M>N); a data storage device that successively stores the first through third color tone data sub-units obtained for a plurality of pixels; and a signal generation device that successively generates and outputs, for a plurality of pixels, first through third control signals for producing each pixel's corresponding second RGB color tone as defined by each pixel's respectively stored first through third color tone data sub-units.

Here, the data conversion device may be structured to include a register circuit or a flip-flop circuit that sets the data values the first to third color tone sub-units defining a respective second RGB color tone in response to an input first image data unit. Also, the first image data unit may have eight bits, the first color tone sub-unit may define a red color tone in four to six bits, the second color tone sub-unit may define a green color tone in four to six bits, and the third color tone data may define a blue color tone in four to six bits.

In accordance with the invention structured in the manner described above, an image data conversion is performed based on any conversion algorithm in a data conversion device built in a driver IC, to thereby expand the range of displayable color tones without increasing the number of bits of image data per pixel that is input to the driver IC from the MPU, and to thereby approximate to true colors of higher resolution than can traditionally be achieved with the image data prior to the conversion.

[Means for Solusion]

A data conversion device, may include a data conversion circuit and a conversion algorithm storage circuit, convert a first image data unit consisting of N bits, based on a set conversion algorithm, into a second image data unit including a first color tone sub-unit consisting of K bits, a second color tone sub-unit consisting of L bits and a third color tone sub-unit consisting of M bits (where K, L, M and N are natural numbers, and K+L+M>N). A data storage device successively stores the first through third color tone sub-unit of each of the second image data units, and a signal generation device successively generates and outputs first through third signals respectively having voltage gradients representative of the stored first through third color tone sub-units.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

An embodiment of the present invention is described below with reference to the accompanying drawings.

Figure 1:
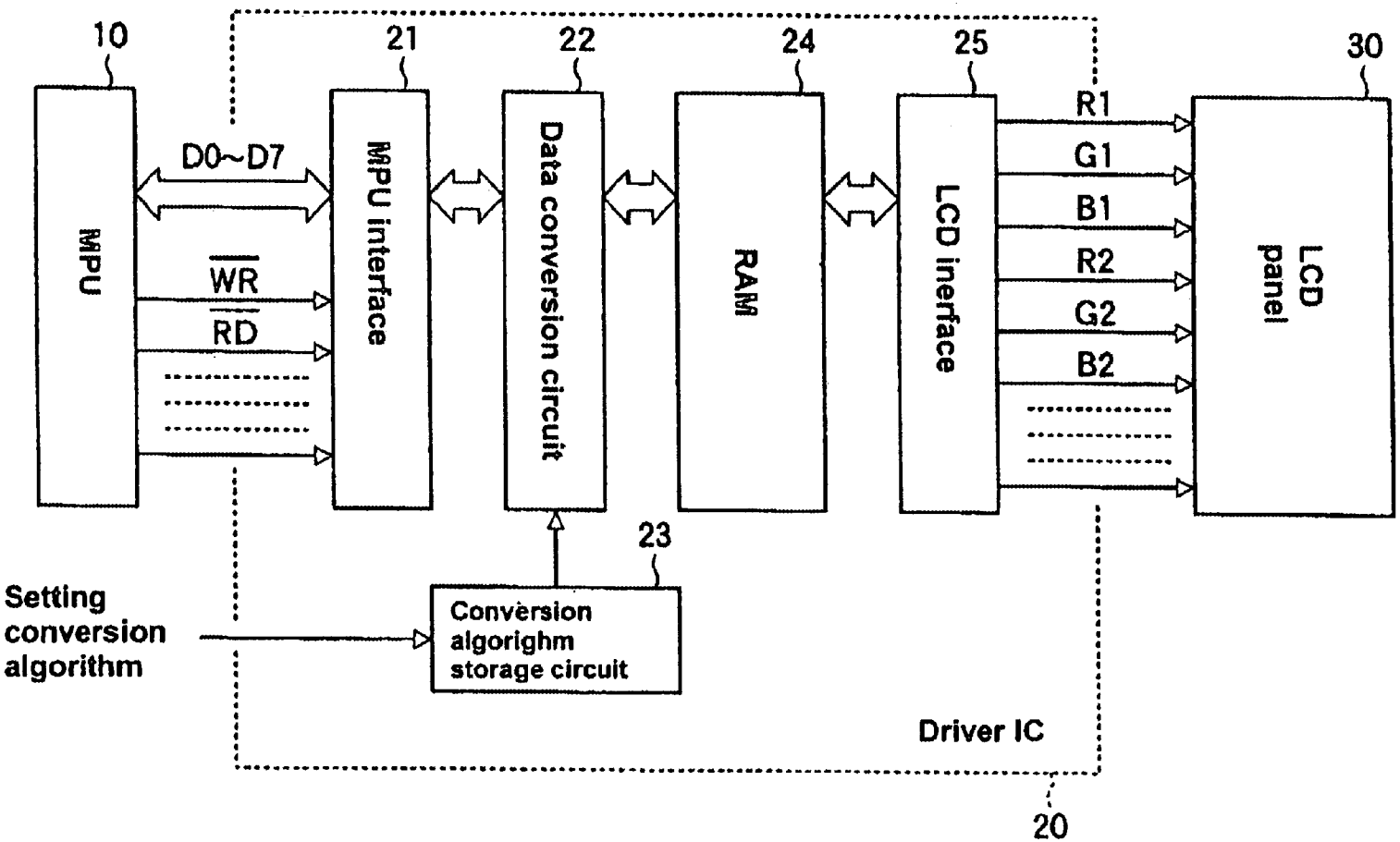
FIG. 1 shows a structure of a semiconductor integrated circuit in accordance with the present invention.

FIG. 1 shows a structure of a semiconductor integrated circuit in accordance with a preferred embodiment of the present invention. In the present embodiment, the present invention is applied to a color LCD driver IC 20.

As shown in FIG. 1, a first image data units, consisting of data bits D0–D7, specifying image data for each pixel are successively input to a driver IC 20 from an MPU 10. Also, a variety of control signals including a write control signal/WR and a read control signal/RD are input to the driver IC 20. Based on the first image data unit and the control signals, the driver IC 20 generates multiple sets of RGB signals, shown as R1-G1-B1, R2-G2-B2, and so on, and outputs them to respective segments of an LCD panel 30.

Figure 2:
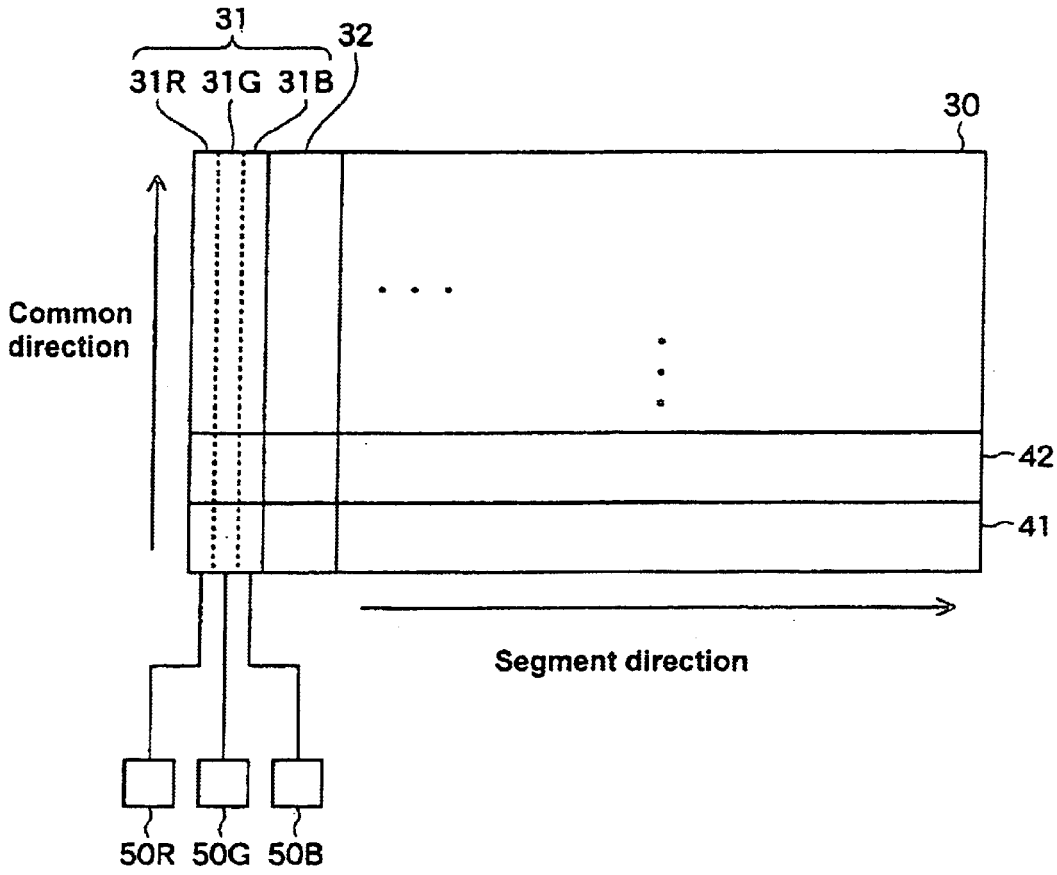
FIG. 2 shows a general structure of an LCD panel that is connected to a semiconductor integrated circuit in accordance with the present invention.

FIG. 2 shows the general structure of the LCD panel 30. The LCD panel 30 includes a plurality of regions 31, 32, and so on, in a segment direction, and also a plurality of regions 41, 42, and so on, in a common direction. It is noted that one pixel (picture element or dot) is defined, or addressed, by specifying one of the regions in the segment direction and one of the regions in the common direction. As an example, the LCD panel 30 may include 160 regions in the segment direction and 120 regions in the common direction. In this case, the LCD panel 30 would have 160×120 pixels.

Furthermore, each of the regions in the segment direction is further divided into three sub-regions each corresponding to a respective one of a red color, a green color, and a blue color. For example, region 31 includes sub-regions 31R, 31G and 31B for displaying RGB colors, respectively. Terminals 50R, 50G and 50B are connected to three elements that apply voltages to these sub-regions, respectively.

Referring back to FIG. 1, the driver IC 20 includes an MPU interface 21 for connecting to the MPU 10, and includes an LCD interface 25 for connecting to the LCD panel 30. Also, the driver IC 20 includes an image data conversion circuit 22 that converts first image data units from MPU 10, which define a respective first RGB color tone, into second image data units that define a respective second RGB color tone. A conversion algorithm storage circuit 23 stores a conversion algorithm that is used the conversion of first image data units to second image data units. Driver IC 20 also includes a RAM 24 for storing the converted second image data units.

The image data conversion circuit 22 converts, based on the conversion algorithm stored in the conversion algorithm storage circuit 23, input first image data units into second image data units having a greater number of bits per unit than that of bits of the first image data units. For example, the image data conversion circuit 22 converts input first image data unit consisting of eight bits each into second image data units consisting of sixteen to 36 bits each. In the present embodiment, the first image data unit is composed of a first set of three bits defining a red color (R) tone , a second set of three bits defining a green color (G) tone, and a third set of two bits defining a blue color (B) tone. The first, second and third bit sets of each first image data unit are converted into respective first, second, and third bit sub-units within a second image data unit, where the first bit sub-unit, is red color tone data preferably consisting of four to six bits, the second bit sub-unit is green color tone data preferably consisting of four to six bits, and the third bit sub-unit is blue color tone data preferably consisting of four to six bits. Herein below, the description is made for the exemplary case in which each of the 3-bit and 2-bit sets of a first image data unit is converted into a respective 4-bit sub-unit of a corresponding second image data unit. This feature is shown in FIG. 3.

Figure 3:
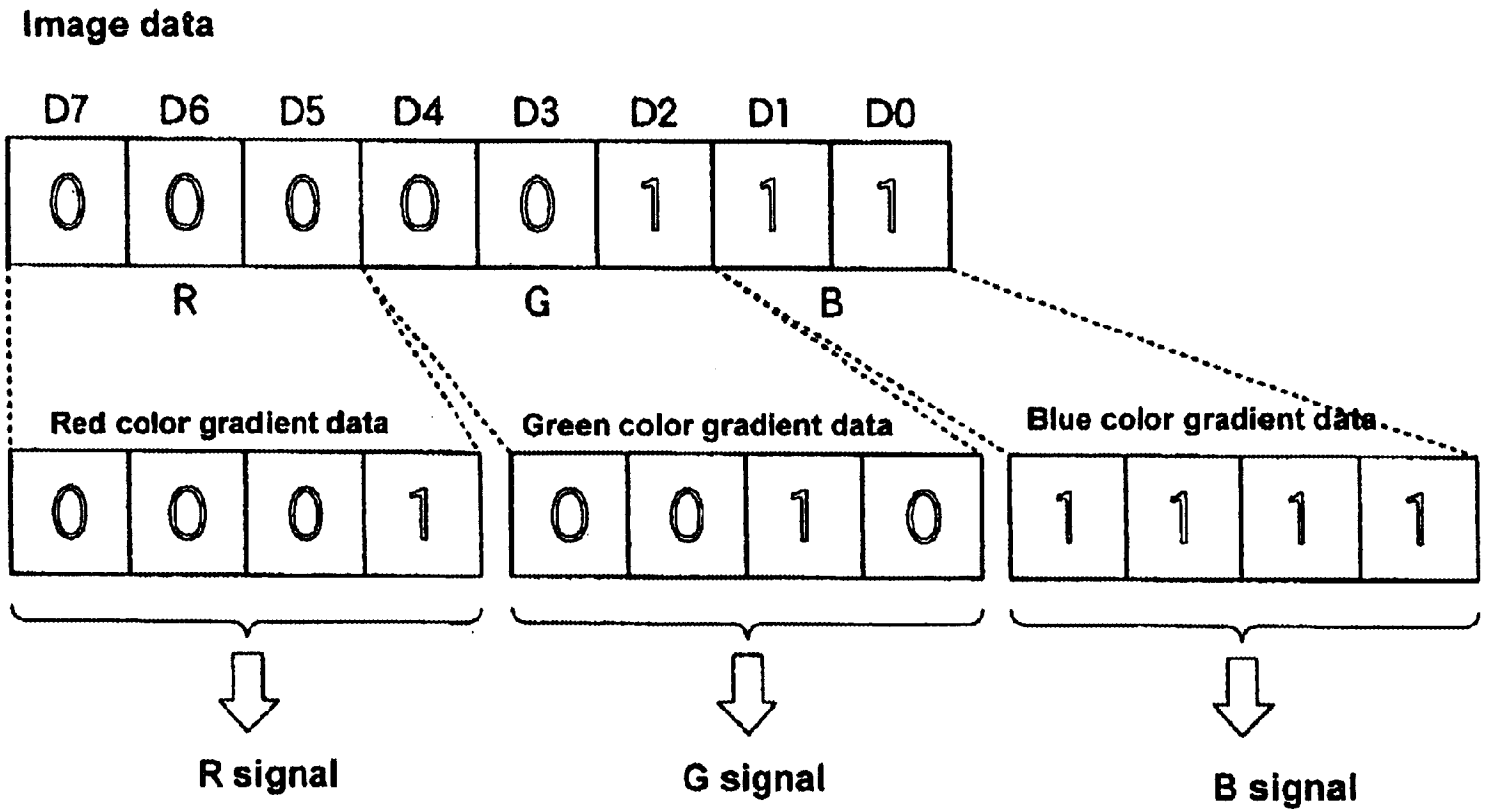
FIG. 3 shows an example of data conversion from a first image data unit to a second image data unit in a preferred color display method in accordance with the present invention.

Referring to FIG. 3, data bits D7–D5 of the first image data unit D7–D0 for one pixel that is input from the MPU 10 are converted to a red color tone image data sub-unit consisting of four bits. The red color tone sub-unit having four bits can represent up to $2^4$, or 16, tones, or gradient hues, of the color red. Similarly, data bits D4–D2 of first image data unit D7–D0 are converted to a green color tone image data sub-unit of four bits. The green color tone sub-unit having four bits can also represent up to 16 tones of the color green. Furthermore, data bits D1–D0 of first image data unit D7–D0 are converted to a blue color tone image data sub-unit of four bits. The blue color tone having four bits can likewise represent up to 16 tones of the color blue. Together, the red, green, and blue color tone sub-units comprise a newly created second image data unit corresponding to the first image data unit supplied by MPU 10.

Here, a user from outside can optionally set the conversion algorithm. For example, the user can set the conversion algorithm depending on the characteristic of an image to be displayed on the LCD panel 30 such that color tones associated with a high brightness can be finely represented, or conversely such that color tones associated with a low brightness can be finely represented. The conversion algorithm set by the user can be retained by using, for example, resistors or flip-flops.

Figure 4:
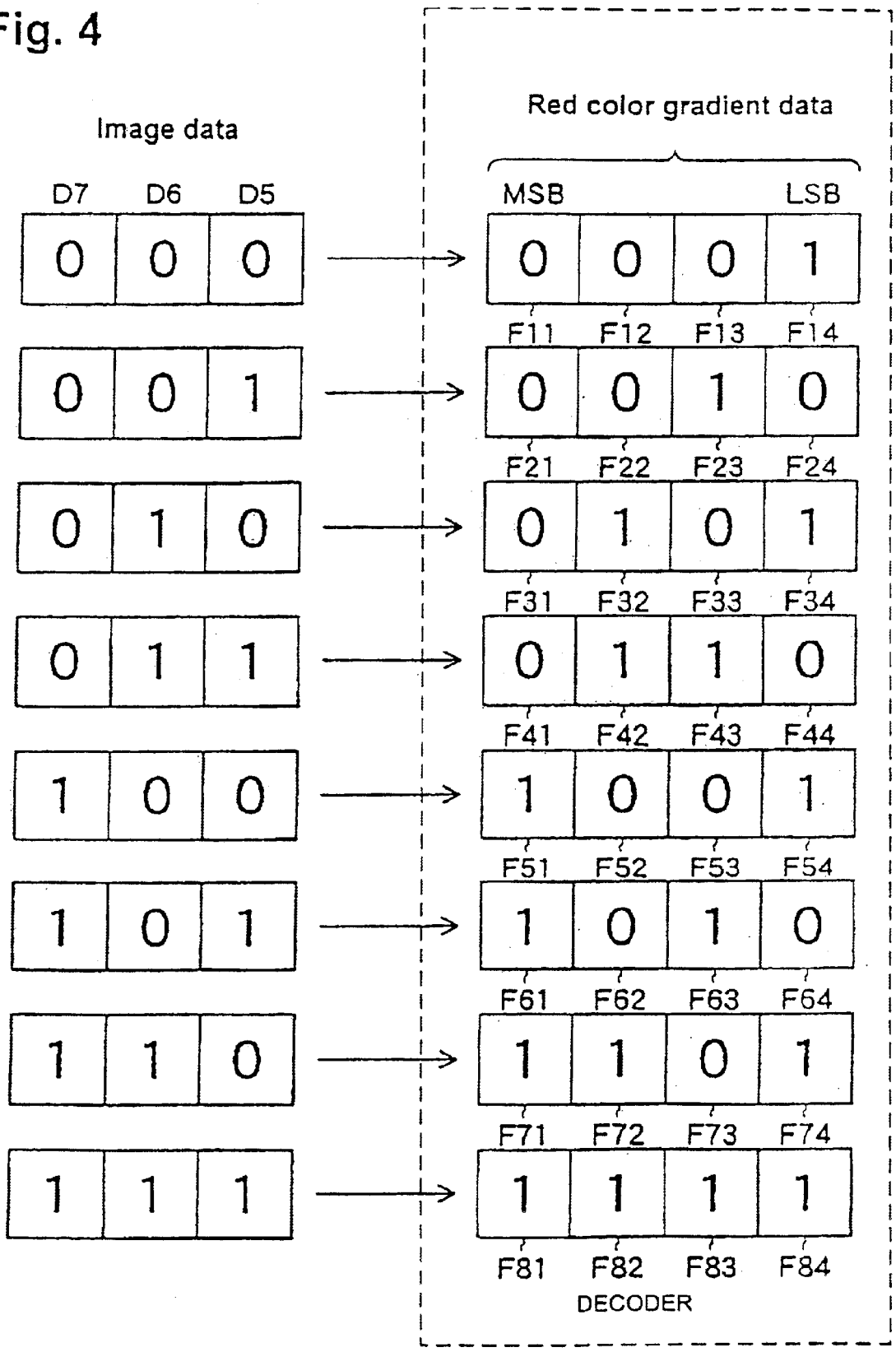
FIG. 4 shows the data content of flip-flops used in conversion algorithms for converting the upper three bits of a first image data unit into four-bit data of a red color tone sub-unit within a second image data unit.
Figure 5:
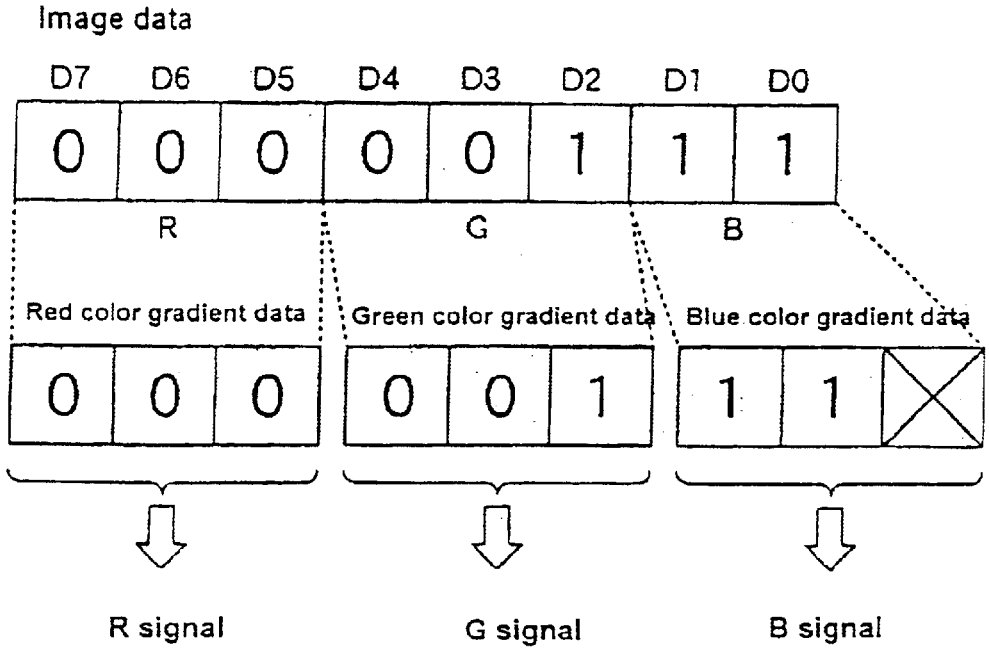
Fig. 5 (PRIOR ART)
FIG. 5 shows the color sub-unit divisions in a conventional image data unit for color display.

FIG. 4 shows the data content of flip-flops F11–F84, which can be set to implement a conversion algorithms for converting the upper three bits D7–D5 of the first image data unit into a 4-bit red color tone sub-unit of a second image data unit. For example, four flip-flops F11–F14 are provided to acquire a red color tone data of "0001" when the upper three bits, D7–D5, of the first image data unit have a data value of "000". Eight, that is $2^3$, different data combinations including the above combination of "000" can be represented by the upper three bits D7–D5 of the first image data unit. Therefore, to achieve a 4-bit red color tone sub-unit, one needs 32 flip-flops, that is, four bits x eight combinations. In essence, the 32 flip-flops form a decoder for associating each of the eight data combinations of the first image data unit's red gradient scale to a corresponding and pre predefined 4-bit representation selected from a second color scale consisting of $2^4$, or 16, color tones. The same applies to first image data unit's green color gradient. For the first image data unit's blue color bit set, which consisting of only two bits, i.e. D1 and D0, 16 flips are required to properly map the four bits×four combinations to a corresponding and predefined 4-bit representation. Therefore, a total of 80 flip-flops are required to convert the 8-bit first image data unit defining three colors of limited color tone range, to a 16-bit second image data unit defining three colors of an expanded color tone range.

The color tone data converted in the manner described above are stored in respective regions in the RAM 24 shown in FIG. 1. The gradient data stored in the RAM 24 are successively supplied to a plurality of segments on the LCD panel 30 by the LCD interface 25.

When the first image data unit is converted into a second image data unit having color tone sub-units using four bits for each color, $(2^4)^3$, or 4096, color tones can be represented. Of the 4096 possible color representations, a first set of 256 color tones among them can be selected according to a first conversion algorithm to correspond to the original 256 color tones definable by the first image data unit. Alternatively, a second set of 256 color tones can be selected among the 4096 according to a second conversion algorithm to correspond to the original 256 color tones definable by the first image data unit. Furthermore, when the first image data unit is converted into a second image data unit having color tone sub-units using six bits for each color, then $(2^6)^3$, or about 260,000, color tones can be represented, and a set of 256 color tones among them can be selected according to another conversion algorithm to correspond to the original 256 color tones definable by the first image data unit.

As described above, in accordance with the present invention, a data conversion is performed based on a designated conversion algorithm in a data conversion device built in a driver IC, to thereby expand the range of displayable color tones without increasing the number of bits per image data unit that is input to a driver IC by an MPU, and to thereby approximate the displaying of true colors, which have a continuous color tone rang larger than the continuous color tone range achievable with the bit count of the image data unit.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A semiconductor integrated circuit comprising:

a data conversion device having an input for receiving arbitrary first image data units of N bits each representing a corresponding one of a plurality of first color tones for a corresponding pixel, wherein N is a natural number not smaller than three, said data conversion device being effective for converting said first image data units, based on a predefined conversion algorithm, into corresponding second image data units each consisting of a first sub-unit of K bits, a second sub-unit of L bits, and a third sub-unit of M bits, wherein K, L and M are natural numbers and the sum of K, L, and M is greater than N;

a data storage device that successively stores said second image data units obtained for a plurality of pixels; and a signal generation device that successively generates and outputs, for a plurality of pixels, first through third signals respectively representing the data stored within said first through third sub-units of a corresponding second image data unit;

where said data conversion device includes a decoder circuit for associating each of said first color tones represented by a corresponding one of said first image data units to one of a plurality of predefined second color tones, the association made by said decoder being determined by said predefined conversion algorithm; and wherein said decoder circuit is implemented as one of a register circuit or a bank of flip-flop circuits.

2. The semiconductor integrated circuit according to claim 1, wherein the continuous color tone range of said plurality of second color tones is greater than the continuous color tone range of said plurality of first color tones.

3. A semiconductor integrated circuit according to claim 1, wherein said first image data unit consists of eight bits, said first sub-unit holds red color tone data and the value of k is set to one of four, five or six bits, said second sub-unit holds green color tone data and the value of L is set to one of four, five, or six bits, and said third sub-unit holds blue color tone data and the value of M is set to one of four, five, or six bits.

4. The semiconductor integrated circuit according to claim 1, wherein said first to third signals use a voltage gradient to represent the data value stored within their corresponding first through third sub-units.

5. Semiconductor integrated circuit according to claim 1, wherein each of said plurality of first color tones represented by said first image data units is a composite color tone defined by a red color tone contribution, a green color tone contribution, and a blue color tone contribution.

6. A semiconductor integrated circuit comprising:

an input for receiving arbitrary first image data units of N bits each representing a corresponding one of a plurality of first color tones for a corresponding pixel;

a data storage having a plurality of predefined second image data units of Z bits, each representing a corresponding one of a plurality of second color tones, wherein Z is greater than N; and a mapping circuit for establishing a predefined one-to-one association between each first image data unit and a corresponding second image data unit;

an output for outputting, for each received first image data unit, its associated second image data unit as determined by said mapping circuit, wherein the N bits of each of said first image data units is sub-divided into first, second and third sub-groups; the Z bits of each of said second image data units is sub-divided into K, L and M bits; within each associated first image data unit and second image data unit, the first, second, and third sub-groups of bits within the associated first image data unit having a predefined association with corresponding K, L, and M bits of its corresponding second image data unit, respectively.

7. The semiconductor integrated circuit of claim 6, wherein, the second color tone corresponding to the outputted second image data becomes associated with the pixel corresponding to the received first image data unit.

8. The semiconductor integrated circuit of claim 6, wherein said K, L, and M are greater than their corresponding first, second, and third sub-groups of bits.

9. The semiconductor integrated circuit of claim 6, wherein said mapping circuit is a dynamic mapping circuit for selectively updating the predefined one-to-one association between each first image data unit and corresponding second image data unit.

10. The semiconductor integrated circuit of claim 6, further including a storage circuit for storing multiple predefined mapping information for selectively updating said dynamic mapping circuit.

11. The semiconductor integrated circuit of claim 9, wherein said dynamic mapping circuit includes a register circuit.

12. The semiconductor integrated circuit of claim 9, wherein said dynamic mapping circuit includes a bank of flip-flop circuits.

* * * * *